US006065739A

United States Patent [19]

Schlossarczyk et al.

[11] Patent Number: 6,065,739

[45] Date of Patent: May 23, 2000

[54] DIAPHRAGM CARBURETOR FOR AN INTERNAL COMBUSTION ENGINE OF A HAND-HELD WORKING TOOL

[75] Inventors: Jörg Schlossarczyk, Winnenden; Reinhard Gerhardy, Korb, both of Germany

[73] Assignee: Andreas Stihl AG & Co., Germany

[21] Appl. No.: 09/116,055

[22] Filed: Jul. 15, 1998

[30] Foreign Application Priority Data

Jul. 15, 1997 [DE] Germany ..... 197 30 281

[51] Int. Cl.[7] ..... F02M 17/04

[52] U.S. Cl. ..... 261/35; 261/69.1; 261/DIG. 68

[58] Field of Search ..... 261/35, 66, 64.1, 261/DIG. 39, DIG. 68, 69.1

[56] References Cited

U.S. PATENT DOCUMENTS 3,371,658 3/1968 Turner ..... 261/35 X
3,738,622 6/1973 Tuckey ..... 261/35
4,481,152 11/1984 Kobayashi et al. ..... 261/35
4,931,226 6/1990 Ishii ..... 261/35 X
5,002,705 3/1991 Kohler ..... 261/35
5,441,673 8/1995 Gerhardy ..... 261/35 X
5,599,484 2/1997 Tobinai ..... 261/35 X
5,681,508 10/1997 Gerhardy ..... 265/35
5,843,345 12/1998 Guntly ..... 261/35 X

*Primary Examiner*—Richard L. Chiesa
*Attorney, Agent, or Firm*—Robert W. Becker & Associates

[57] ABSTRACT

A diaphragm carburetor for an internal combustion engine of a portable hand-held working tool has a housing with a control chamber. A suction channel extends through the housing and has a venturi section. An inlet valve is connected to the control chamber and supplies the control chamber with fuel. A main valve channel connects the control chamber to the venturi section of the suction channel. A check valve is positioned in the main valve channel adjacent to the control chamber and closes the main valve channel toward the control chamber. The main valve channel has a straight and elongate portion extending from the check valve into the venturi section and projecting into the suction channel.

11 Claims, 2 Drawing Sheets

DIAPHRAGM CARBURETOR FOR AN INTERNAL COMBUSTION ENGINE OF A HAND-HELD WORKING TOOL

BACKGROUND OF THE INVENTION

The present invention relates to a diaphragm carburetor for an internal combustion engine, especially for an internal combustion engine in a portable, hand-guided working tool such as a motor chain saw etc., comprising a fuel-filled control chamber that is supplied via an inlet valve from a fuel reservoir and comprising a main valve channel connecting the control chamber to a venturi section of the suction channel. The main valve channel has a check valve that closes the main valve channel in the direction towards the control chamber and is arranged in the vicinity of the control chamber.

From German Patent Application 195 09 943 a diaphragm carburetor of the aforementioned kind is known having a control chamber that is connected by an idle system as well as the main valve channel to the suction channel and the internal combustion engine. At the outlet opening of the main channel the valve plate is arranged which closes the outlet opening in the manner of a check valve when in the idle position due to the vacuum level in the control system a return flow of air into the control chamber would be possible. Due to the engine vibrations to which the carburetor is subjected in idle position, the check valve plate is pressure-loaded by the fuel column positioned thereat so that in certain operational situations fuel can exit via the main valve which may result in great fluctuations of the idle rpm. In extreme cases, when the mixture is too rich, the internal combustion engine will stop.

It is known to guide the fuel flow from the control system to the venturi section via channels, transverse bores, or other throttle locations. These systems, under full load of the engine, exhibit considerable fluctuations during operation.

It is therefore an object of the present invention to improve a diaphragm carburetor of the aforementioned kind such that with a simple embodiment of the main valve channel the vibrations resulting from the engine will not result in opening of the check valve in the main valve channel.

SUMMARY OF THE INVENTION

A diaphragm carburetor for an internal combustion engine of a portable hand-held working tool according to the present invention is primarily characterized by a housing, a control chamber arranged in the housing, a suction channel extending through the housing and having a venturi section, and an inlet valve connected to the control chamber and supplying the control chamber with fuel. A main valve channel connects the control chamber to the venturi section of the suction channel. A check valve is positioned in the main valve channel adjacent to the control chamber and closes the main valve channel in the direction toward the control chamber. The main valve channel has a straight and elongate portion extending from the check valve into the venturi section and projecting into the suction channel.

The main valve channel has a widened portion forming a valve chamber in which the check valve is positioned. The check valve has a valve opening forming a direct and short connection between the control chamber and the valve seat of the check valve. The valve opening is a fixed diameter throttle.

The check valve includes a closure plate in which the valve opening is arranged. The closure plate delimits the valve chamber toward the control chamber.

The check valve includes a valve plate and a support ring. The support ring defines the open position of the check valve. The valve plate is freely moveable between the closure plate and the support ring. The valve chamber has a bottom facing the straight and elongate portion, and the support ring is secured at the bottom.

The valve chamber has a circumferential groove, and the support ring is preferably snapped into the circumferential groove.

The support ring may have support arms projecting into the valve chamber. The support arms extend preferably parallel to the central longitudinal axis of the straight and elongate portion.

The valve chamber has expediently a transition portion tapering in a direction toward the straight and elongate portion and reducing the diameter of the valve chamber to the diameter of the straight and elongated portion.

The check valve, the valve chamber, and the straight and elongate portion together form an integral insert received in the housing. The main valve channel has an outlet bore extending transverse to the straight and elongate portion and having a first outlet opening into the suction channel. In a preferred embodiment of the invention, the outlet bore extends diametrically through the straight and elongate portion and has a second outlet opposite the first outlet.

The outlet bore extends transverse to the air flow passing through the suction channel.

Expediently, the end of the straight and elongate portion projecting into the suction channel is closed off.

Between the check valve and the suction channel a fuel column is formed within the elongate and straight channel which is a buffer between the pressure fluctuations within the suction channel and the check valve. Practical experiments have shown that due to the elongate and straight portion of the main valve channel the fuel column has a very high mass inertia so that the pressure pulses occurring at the engine side will not reverse the flow direction of the fuel which could result in air flowing in the direction of the control chamber and thus could result in disruptions of the fuel supply. The more uniform flow velocity (constant Reynolds numbers) as well as the minimization of deflections, which have been straightened by manufacturing technological processes, a substantially improved processability of the fuel throughput is achieved.

Preferably, the check valve is positioned in a widened portion of the main valve channel whereby the valve opening of the check valve forms a direct connection between the control chamber and the straight and elongate portion of the main valve channel. Preferably, the valve opening is a throttle of fixed diameter. Between the check valve and the control chamber there are therefore no channels or similar flow paths. The valve chamber is closed off relative to the control chamber by the closure plate which has a valve opening in the form of a fixed diameter throttle. The valve member, which is embodied as a valve plate, is freely moveable between the closure plate and the support ring that defines the open position of the valve.

In order to obtain a maximum vacuum from the flow velocity produced in the venturi section, it is suggested to provide the exit of the main valve with a transverse bore which is positioned perpendicular to the air flow direction. The flow velocity of the air mass thus produces maximum vacuum which can be used for conveying fuel and ensures, especially during acceleration, a spontaneous fuel flow.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 and 2.

Figure 1:
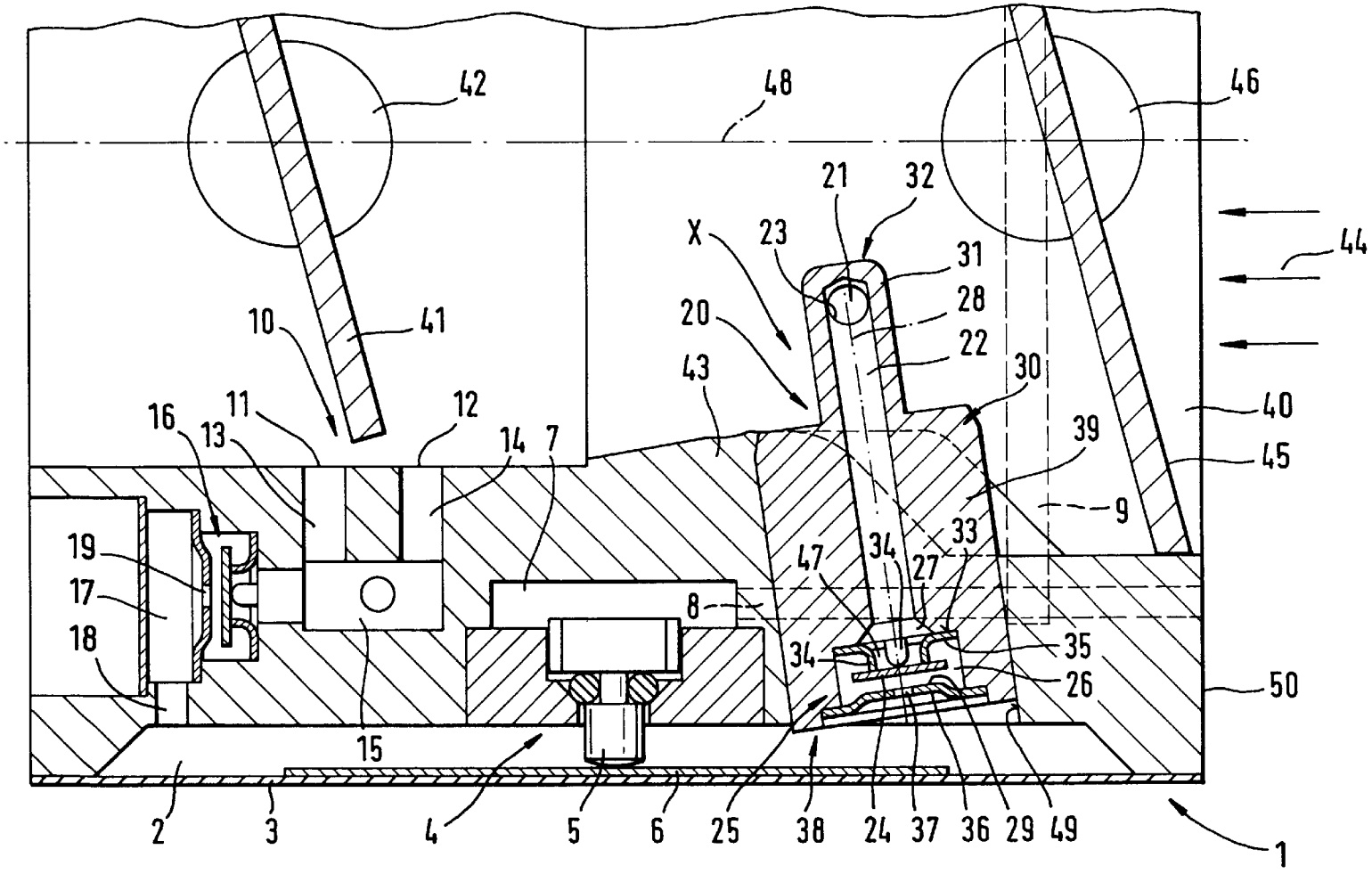
FIG. 1 is a schematic representation of a part sectional view of a diaphragm carburetor.

The diaphragm carburetor 1 represented in FIG. 1 serves as a fuel supply for an internal combustion engine, for example, a two-stroke engine for a portable hand-held working tool such as a motor chain saw, a cutter, a separating cutter etc. The combustion engine can also be a four-stroke engine.

The schematically represented diaphragm carburetor is comprised of a control chamber 2 which is delimited by a control diaphragm 3. An inlet valve 4 is arranged centrally relatively to the control chamber 2 and has an actuating push rod 5 projecting into the control chamber 2 that is actuated by a central diaphragm plate 6 of the diaphragm 3. The valve chamber 7 of the inlet valve 4 is connected by supply lines 8 and 9 to a non-represented fuel reservoir. Preferably, a fuel pump is arranged between the fuel reservoir and the valve chamber 7.

The control chamber 2 is connected by an idle system 10 and a main valve channel 20 to the suction channel 40 of the diaphragm carburetor.

The idle system 10 opens via two idle openings 11 and 12 in the area of the throttle flap 41 into the suction channel 40 whereby the throttle flap 41 is pivotally secured by a throttle flap shaft 42 within the suction channel 40. The idle openings 11 and 12 are connected by idle bores 13 and 14 to an idle chamber 15 which is connected by check valve 16 and a valve chamber 17 as well as a supply bore 18 to the control chamber 2. The flow opening 19 of the check valve 16 is expediently embodied as a throttle having a fixed diameter. The check valve 16 is of the same construction as the check valve 25 of the main valve channel. The check valve 25 will be explained in the following.

The main valve channel 20 projects in the area of the venturi section 42 into the suction channel 40. Relative to the combustion air 44 flowing through the suction channel 40, the main valve channel 20 is positioned downstream of a choke 45 which is pivotally supported on a shaft 46 within the suction channel 40. The main valve channel 20 is positioned with its longitudinal axis 28 in the flow direction of the combustion air 44 at a slant to the longitudinal center axis 48 of the suction channel 40. Expediently, the main valve channel 20 is embodied within an insert 30 which is manufactured separately from the diaphragm carburetor 1. The insert 30 is then inserted into a corresponding receiving opening 49 of the carburetor housing 50.

The insert 30 is preferably embodied as a stepped cylindrical body whereby the portion 39 having the greater diameter is substantially received in the receiving opening 49 of the housing 50. The portion 31 having the smaller diameter projects substantially in the area of the venturi section 43 into the suction channel 40.

The main valve channel 20 is embodied as a straight and elongate central channel portion 22 within the insert 30 which extends substantially from the end 32 to the opposite end 38 of the insert 30. In the embodiment represented in FIG. 1, the straight and elongate channel portion 22 is closed off at the end 32 projecting into the suction channel 40. The outlet 21 of the main valve channel 20 is positioned perpendicular to the longitudinal center axis 28 and is expediently embodied as a transverse bore 23. Preferably, the transverse outlet bore 23 is embodied as a bore extending from end to end so that the straight and elongate portion 22 of the main valve channel 20 in the area of the closed-off end 32 is provided at its circumference with two diametrically oppositely arranged outlets 21. The transverse outlet bore 23 is positioned transverse to the longitudinally center axis 48 of the suction channel 40 so that the fuel exits transverse to the flow direction of the combustion air 44.

The end 38 facing the control chamber 2 has a widened portion in which the valve chamber 26 is located whereby between the smaller diameter of the channel 22 and the larger diameter of the valve chamber 26 a transition portion 27 is provided which tapers in the direction toward the portion 22.

In the valve chamber 26 the check valve 25 is arranged which opens toward the straight and elongate portion 22 and has a valve member in the form of a valve plate 24. The valve plate 24 is freely moveable between the valve seat 29 and a support ring 35 within the valve chamber 26. The valve seat 29 is arranged on a side of the closure plate 36 facing the valve plate and is securely held at it circumference in a groove of the insert 30. The closure plate 36 has a central valve opening 37 which is preferably a throttle of a fixed diameter for allowing fuel flow from the control chamber 2 into the straight and elongate portion 22 of the main valve channel 20. The valve plate 24 is positioned with radial play within the valve chamber 26 whereby the play is dimensioned such that, even when contacting the circumferential wall of the valve chamber 26, a safe and complete contact on the valve seat 29 is ensured (FIG. 2).

The open position of the valve shown in FIG. 1 shows the valve plate 24 secured at the support ring 35 which is fixedly secured at the bottom 33 of the valve chamber 26. The support ring 35 in the shown embodiment has four support arms 34 projecting in the direction toward the closure plate 36 into the valve chamber 26 and extending substantially parallel to the longitudinal axis 28 of the straight and elongate portion 22. In the shown embodiment the support ring 35 has four support arms 34 uniformly supported about the circumference of the support ring 35. It may be expedient to change the number of support arms 34. The flow cross-section in the open position in the check valve 25 is determined by the gap 47 between the two neighboring support arms 34. Expediently, the support arms 34 are rounded at their free ends so that only a minimal contact surface results at the valve plate 24.

Figure 2:
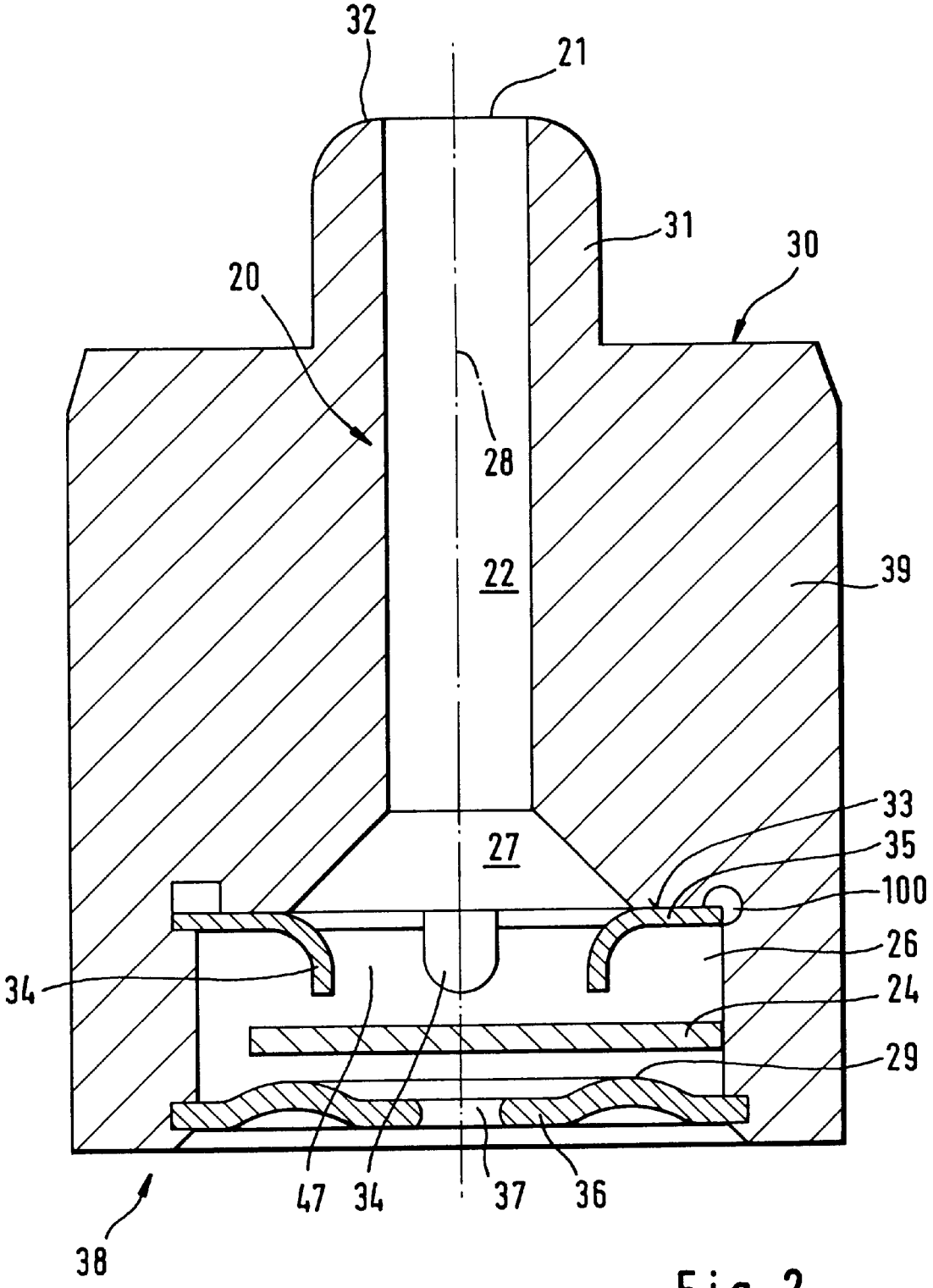
FIG. 2 is an enlarged detail X of FIG. 1 of a further embodiment.

The embodiment according to FIG. 2 corresponds in its basic design of the insert 30 to the design of FIG. 1 so that for the same parts the same reference numerals are being used. In the embodiment according to FIG. 2 the free end 32 of the straight and elongate portion 22 is open at the suction channel 40 and thus forms the only outlet 21 of the main valve channel 20. In this embodiment the portion 31 having the smaller diameter can be shorter than in the embodiment of FIG. 1.

The straight and elongate portion 22 during operation of the internal combustion engine is substantially always filled with fuel so that, when pressure fluctuations within the suction channel 40 occur, the high pressure results in a safe closure of the check valve 25 due to the hydraulic pressure colulm within the portion 22 provided by the fuel column. Dripping of the main valve at the outlet 21 of the channel 20 can thus be substantially prevented by the inventive construction.

The present invention is, of course, in no way restricted to the specific disclosure of the specification and drawings, but also encompasses any modifications within the scope of the appended claims.

What is claimed is:

1. A diaphragm carburetor for an internal combustion engine of a portable hand-held working tool, said carburetor comprising:

a housing;

a control chamber arranged in said housing;

a suction channel extending through said housing and having a venturi section;

an inlet valve connected to said control chamber and supplying said control chamber with fuel;

a main valve channel connecting said control chamber to said venturi section of said suction channel;

a check valve positioned in said main valve channel adjacent to said control chamber and closing said main valve channel toward said control chamber;

said main valve channel having a straight and elongate portion extending from said check valve into said venturi section and projecting into said suction channel;

said main valve channel having a widened portion forming a valve chamber in which said check valve is positioned;

said check valve comprising a closure plate delimiting said valve chamber toward said control chamber;

said closure plate having a valve seat facing said control chamber;

said check valve comprising a valve member freely moveably arranged in said valve chamber and having a first end position in which said valve member rests against said valve seat and said check valve is closed;

said closure plate having a valve opening forming a direct short connection between said control chamber and said valve seat of said check valve; and said valve opening being a fixed diameter throttle.

2. A carburetor according to claim 1, wherein:

said check valve comprises a support ring;

said support ring defines a second end position of said valve member in which said check valve is in an open position;

said valve member is a valve plate that is freely moveable between said valve seat and said support ring.

3. A carburetor according to claim 2, wherein said valve chamber has a bottom facing said straight and elongate portion and wherein said support ring is secured at said bottom.

4. A carburetor according to claim 3, wherein said valve chamber has a circumferential groove and wherein said support ring is snapped into said circumferential groove.

5. A carburetor according to claim 2, wherein said support ring has support arms projecting into said valve chamber and wherein said support arms extend parallel to a central longitudinal axis of said straight and elongate portion.

6. A carburetor according to claim 1, wherein said valve chamber has a transition portion tapering in a direction toward said straight and elongate portion and reducing a diameter of said valve chamber to a diameter of said straight and elongate portion.

7. A carburetor according to claim 1, wherein said check valve, said valve chamber, and said straight and elongate portion together form a common insert received in said housing.

8. A carburetor according to claim 1, wherein said main valve channel has an outlet bore extending transverse to said straight and elongate portion and having a first outlet opening into said suction channel.

9. A carburetor according to claim 8, wherein said outlet bore extends diametrically through said straight and elongate portion and has a second outlet opposite said first outlet.

10. A carburetor according to claim 8, wherein said outlet bore extends transverse to an air flow passing through said suction channel.

11. A carburetor according to claim 1, wherein an end of said straight and elongate portion projecting into said suction channel is closed off.

* * * * *